US005884805A

United States Patent [19]

Tramontina

[11] Patent Number: 5,884,805

[45] Date of Patent: Mar. 23, 1999

[54] OVERFILL PREVENTION SYSTEM FOR FOLDED SHEET DISPENSER

[75] Inventor: Paul Francis Tramontina, Alpharetta, Ga.

[73] Assignee: Kimberly-Clark Corp., Neenah, Wis.

[21] Appl. No.: 736,091

[22] Filed: Oct. 24, 1996

[51] Int. Cl.[6] ..... B65H 1/00

[52] U.S. Cl. ..... 221/45; 221/47; 221/61; 221/62; 221/282; 312/34.1

[58] Field of Search ..... 221/45, 46, 47, 221/48, 49, 61, 62, 282; 312/34.1, 34.4, 35, 42

[56] References Cited

U.S. PATENT DOCUMENTS

| | | | |
|---|---|---|---|
| 2,426,787 | 9/1947 | O'Neil | 221/45 |
| 3,341,067 | 9/1967 | Bastian | 221/44 |
| 4,938,382 | 7/1990 | Frazier et al. | 221/45 |

FOREIGN PATENT DOCUMENTS

0506243A1 9/1992 European Pat. Off. .

OTHER PUBLICATIONS

PCT Counterpart International Search Report mailed Feb. 4, 1998.

*Primary Examiner*—William E. Terrell
*Assistant Examiner*—Khoi H. Tran
*Attorney, Agent, or Firm*—K. V. Sidor

[57] ABSTRACT

An overfill prevention system for an folded sheet dispenser. The system is composed of: 1) a cover including a front face, a first side panel, a second side panel and a top panel; 2) a mounting frame adapted to hold a supply of folded sheets and to engage the cover, the mounting frame including a back panel and a bottom portion having at least one dispensing opening; and 3) at least one overfill bracket movably connected to the mounting frame such that an over-capacity of folded sheets in the mounting frame displaces the overfill bracket to prevent the mounting frame from engaging the cover. The system may include means to prevent deformation of the cover to override an overfill bracket displaced by an over-capacity of folded sheets. The system may include over-fill bracket with sloped surface to prevent folded sheets from being positioned over the overfill bracket. Desirably, the cover is pivotally attached to the mounting frame by links. The folded sheets may be folded paper towels, folded bath tissues or the like.

4 Claims, 9 Drawing Sheets

OVERFILL PREVENTION SYSTEM FOR FOLDED SHEET DISPENSER

FIELD OF THE INVENTION

This invention generally relates the field of dispensing devices and systems. More particularly, this invention relates to the field of devices and systems for dispensing folded sheets of material.

BACKGROUND

Dispensers of sheet products in roll form are simple and reliable because the rolls are easy to load and very difficult to overload or overstuff. However, products in roll form present some dispensing problems. A single roll dispenser with a nearly depleted roll must be monitored carefully by maintenance personnel to avoid running out at an inconvenient moment. Changing a partially depleted roll results in wasted product. Moreover, some single roll dispensers are designed so a roll cannot be removed until it is depleted and only a core is left.

Dispensers have been designed to hold reserve rolls. However, these dispensers have disadvantages. They take up more space and can be subject to pilferage. Reserve roll dispensers may require mechanisms that can be relatively complex to provide access to the reserve roll. Such mechanism may be subject to jamming or failure. Reserve roll dispensers may also require some action by a user to access the reserve roll. This typically requires the user to touch or contact the body of the dispenser which may be, in some settings, less than desirable for aesthetic or hygienic reasons.

Devices that dispense single sheets of product are desirable because the can be refilled when only partially depleted. Since no reserve roll is present, the devices are less prone to pilferage. Single sheet dispensers are also desirable because they tend to be simple devices that are not subject to jamming or failure. Devices that dispense folded sheet products are particularly desirable if the products can be dispensed continuously, reliably and can be accessed without touching the dispenser.

A major disadvantage of folded sheet dispensers is that they can be overloaded or overfilled. Overfilling the dispenser can create pressure against the stack of sheets that makes it very difficult to remove a sheet from the dispenser. For example, the pressure against the stack may prevent a "tab" end of the sheet from becoming accessible preventing a user from having a portion of the sheet to grasp in order to withdraw it. The stack of sheets may be wedged in the dispenser so firmly that the portion of the sheet grasped by the user simply tears instead of dispensing a single sheet. Friction against the dispensing opening may be increased by overfilling the dispenser making dispensing unreliable and problematic.

Another problem associated with folded sheet dispensers is encountered when a new stack or clip of interfolded sheets is loaded in the dispenser on top of a partially depleted stack or clip of interfolded sheets. While the sheets in each stack may be interfolded, the last sheet of the partially depleted stack and the first sheet of the new stack are not interfolded. When the first sheet of the new stack reaches the dispensing position the leading edge or "tab" end of the sheet may be difficult for a user to grasp because it was not interfolded and drawn out by the previous sheet to form a tail at the dispensing opening.

In view of the above, a need exists for a system to prevent the overloading or overfilling of single sheet or interfolded sheet dispensers. A need also exists for such an overfill prevention system that is difficult to override or thwart.

There is also a need for a system to improve the dispensing of single sheet or interfolded sheet dispensers which addresses the problem encountered with starting a new stack or clip of sheets in such dispensers or when product is misaligned in a dispenser or when a "tab" end or tail is not accessible. A need exists for a system to provide an improved dispensing geometry as part of an overfill prevention system.

Meeting these needs are important because it is highly desirable to improve the operation of folded sheet dispensers to provide high capacity "no touch" dispensing. Meeting these needs would provide the positive benefits of creating systems that improve the reliability of folded sheet dispensers so the many advantages of such dispensers may be fully exploited.

SUMMARY OF THE INVENTION

The problems and needs described above are addressed by the present invention which provides an overfill prevention system for an folded sheet dispenser. The system is composed of: 1) a cover including a front face, a first side panel, a second side panel and a top panel; 2) a mounting frame adapted to hold a supply of folded sheets and to engage the cover, the mounting frame including a back panel and a bottom portion having at least one dispensing opening; and 3) at least one overfill bracket movably connected to the mounting frame such that an over-capacity of folded sheets in the mounting frame displaces the overfill bracket to prevent the mounting frame from engaging the cover.

The overfill prevention system may include means to prevent deformation of the cover to override an overfill bracket displaced by an over-capacity of folded sheets. For example, at least two ribs may be mounted on opposite edges of the mounting frame so that the ribs prevent the mounting frame from engaging the cover when the cover is deformed to override an overfill bracket displaced by an over-capacity of folded sheets.

The overfill prevention system may include means to prevent folded sheets from being positioned over the overfill bracket. For example, one or more ribs may be mounted on an interior portion of the top panel of the cover, the ribs being positioned to contact folded sheets positioned over the overfill bracket so the mounting frame is prevented from engaging the cover.

Desirably, the cover is pivotally attached to the mounting frame by attachment means. The attachment means include a first and second side portion of the mounting frame, each side portion including a pivot opening; and pivot links incorporated into the cover, the pivot links being adapted to mount into the pivot openings in the side portions of the mounting frame.

The overfill prevention system of the present invention is designed to work with gravity-operated dispensers that may dispense a variety of folded sheets including, but not limited to, folded paper towels, folded bath tissues, folded wipers, folded napkins and the like. Desirably, the folded sheets are interfolded such that withdrawal of one sheet pulls out a portion of the next sheet so it is available to grasp without touching the dispenser.

An embodiment of the present invention relates to an overfill prevention system for a folded sheet dispenser, the system being composed of: 1) a cover including a front face, a first side panel, a second side panel and a top panel; 2) a mounting frame adapted to hold a supply of folded sheets and to engage the cover, the mounting frame including a back panel and a bottom portion having at least one dispensing opening; and 3) at least one overfill bracket having a lower section and an upper section, the bracket being movably connected to the mounting frame such that an over-capacity of folded sheets in the dispenser displaces the lower section of the bracket causing the upper section of the bracket to protrude from the mounting frame to prevent the mounting frame from engaging the cover.

The overfill prevention system may include means to prevent deformation of the cover to override an overfill bracket displaced by an over-capacity of folded sheets. The overfill prevention system may include means to prevent folded sheets from being positioned over the overfill bracket. Desirably, the cover is pivotally attached to the mounting frame by attachment means.

In an aspect of the present invention, the cover may include a recessed portion on an interior portion of the top panel, the recessed portion being positioned to fit over the overfill bracket such that the overfill bracket is not prematurely engaged in the absence of an over-capacity of folded sheets in the dispenser.

The overfill prevention system of the present invention may also include improved dispensing geometry features. The bottom portion of the mounting frame defining the dispensing opening may be set at an angle ranging from about 5 degrees to about 20 degrees so the dispensing opening opens up toward the front of the dispenser. For example, the bottom portion of the mounting frame defining the dispensing opening may be set at an angle ranging from about 7 degrees to about 18 degrees. As another example, the bottom portion of the mounting frame defining the dispensing opening may be set at an angle ranging from about 10 degrees to about 15 degrees.

The dispensing opening may have a generally triangular shape with rounded edges. Desirably, the height of the triangle may range from about 0.5 to about 0.85 times the base of the triangle. For example, the height of the triangle may range from about 0.6 to about 0.75 times the base of the triangle. As another example, the height of the triangle may range from about 0.67 to about 0.7 times the base of the triangle.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION

Figure 1:
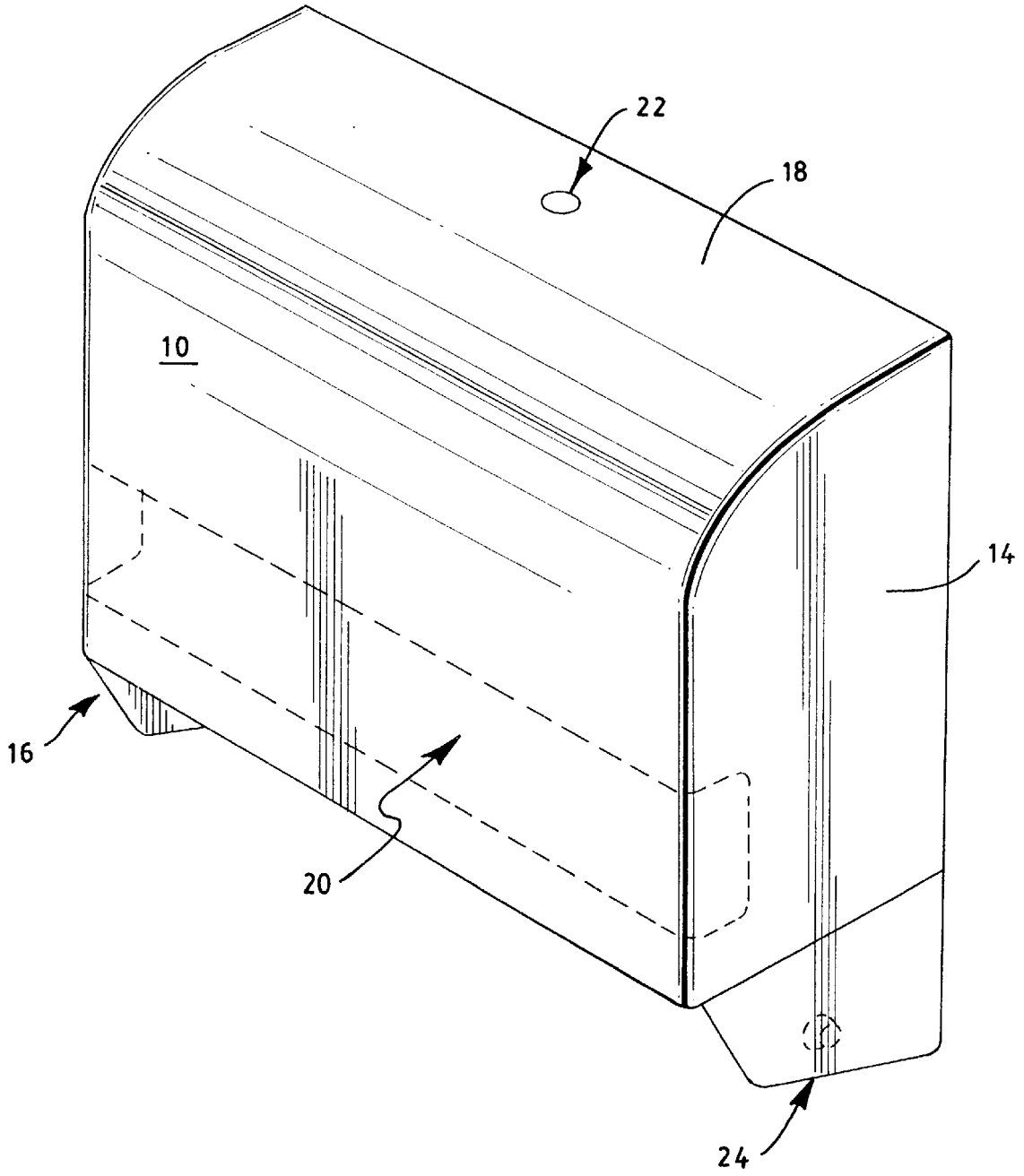
FIG. 1 is a perspective view illustration of a cover from an exemplary overfill prevention system.
Figure 2:
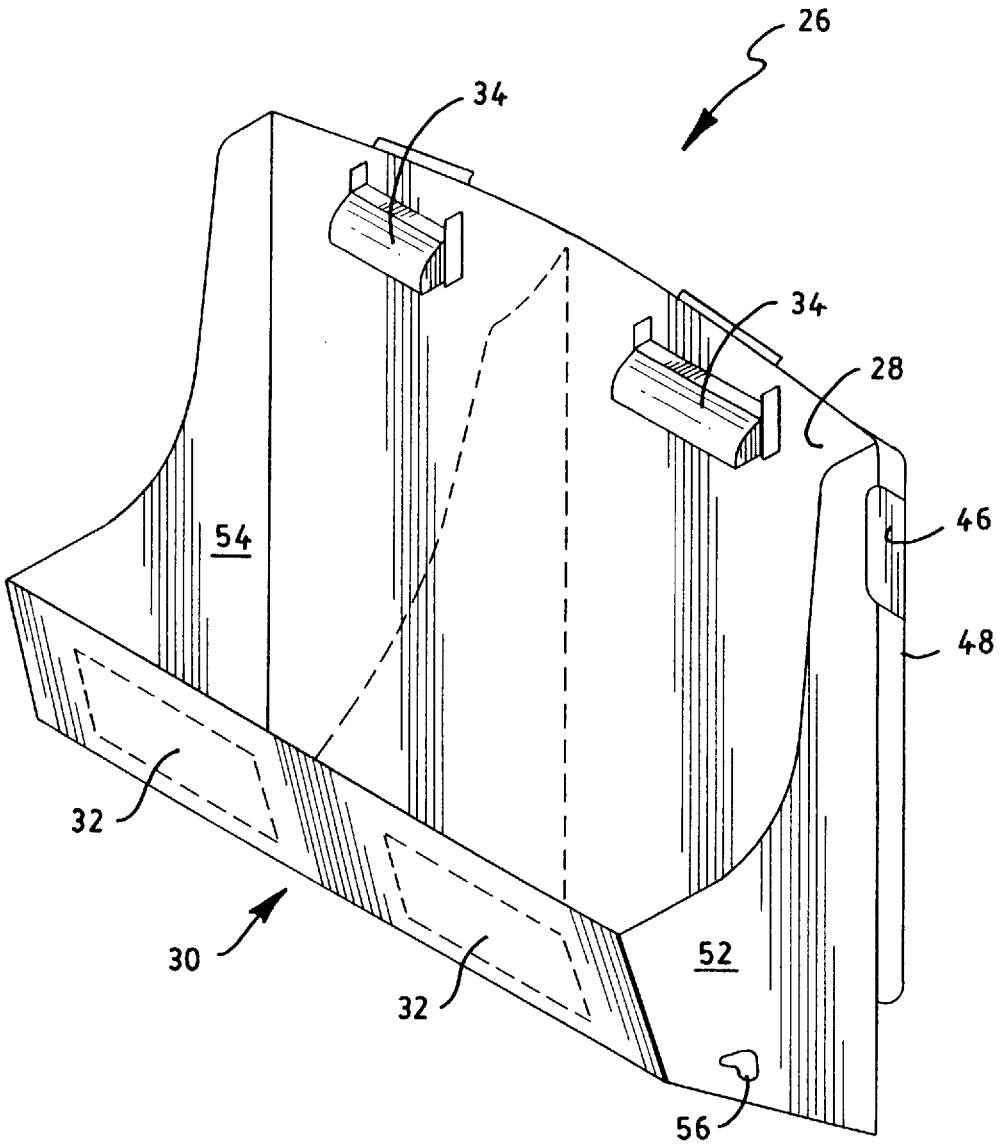
FIG. 2 is a perspective view illustration of a mounting frame from an exemplary overfill prevention system.

Referring now to the drawings, wherein like reference numerals designate corresponding structure throughout the views, and referring in particular to FIGS. 1 and 2, there is shown an exemplary overfill prevention system for an folded sheet dispenser. Referring to FIG. 1, the system includes a cover 10 composed of a front face 12, a first side panel 14, a second side panel 16 and a top panel 18. The cover may include a optional rectangular cutout 20 which may hold a lens (not shown) which may hold decorative strips or may function as an observation lens that allows users and maintenance to check the supply of folded sheets. Of course, the cover may be equipped with additional features including, but not limited to, latch mechanisms 22 and attachment means 24.

Another component of the system is shown in FIG. 2 which depicts a mounting frame 26 adapted to hold a supply of folded sheets (not shown) and to engage the cover 10. The mounting frame 26 includes a back panel 28 and a bottom portion 30 having at least one dispensing opening which is not visible in this particular view. The mounting frame 26 may include optional view windows 32 that allows users and maintenance to check the supply of folded sheets.

Also shown in FIG. 2 are overfill brackets 34 movably connected to the mounting frame 26. The overfill brackets 34 are connected to the mounting frame 26 such that an over-capacity of folded sheets (not shown) in the mounting frame displaces the overfill bracket to prevent the mounting frame from engaging the cover.

Figure 3:
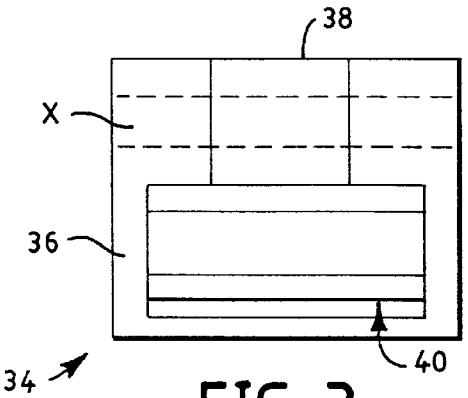
FIG. 3 is a front view illustration of an overfill bracket from an exemplary overfill prevention system.

FIG. 3 is a front view of an exemplary overfill bracket 34 showing a base 36, an upper section 38 and a lower section 40. An optional slot "X" is indicated by broken lines.

Figure 4:
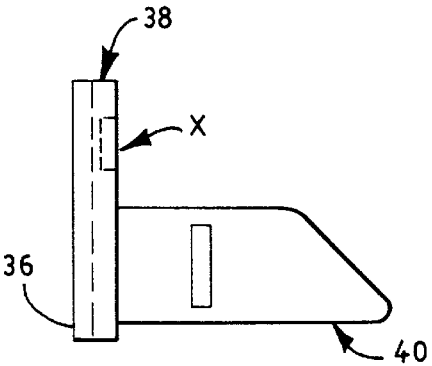
FIG. 4 is a side view illustration of an overfill bracket from an exemplary overfill prevention system.

FIG. 4 is a side view of an exemplary overfill bracket 34 showing a base 36, an upper section 38 and a lower section 40. An optional slot "X" is indicated by broken lines.

Figure 5:
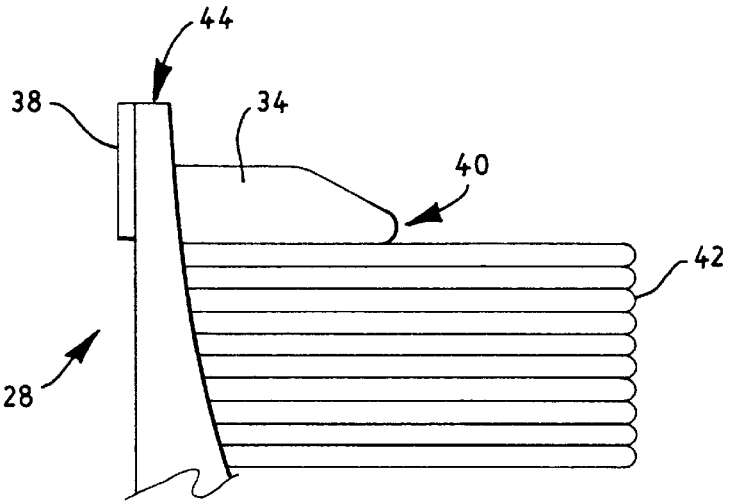
FIG. 5 is a side view illustration of an overfill bracket with a normal full supply of folded sheets.

The overfill bracket 36 is movably connected to the back panel 28 of the mounting frame. FIG. 5 depicts the mounting frame 26 with a normal full supply of folded sheets 42. As is evident from the illustration, when the mounting frame 26 holds a normal full supply of folded sheets 42, the lower section 40 of the overfill bracket 34 contacts the top of the folded sheets 42 but is not displaced vertically so the upper portion 38 of the overfill bracket 34 does not protrude beyond the upper edge 44 of the mounting frame 26. It should be noted that when less than a full supply of folded sheets 42 is present in the mounting frame 26, the overfill bracket 34 is maintained in this position by the snaps, channels, grooves and other conventional components that movably connect the overfill bracket 34 to the back panel 28 of the mounting frame 26.

Figure 6:
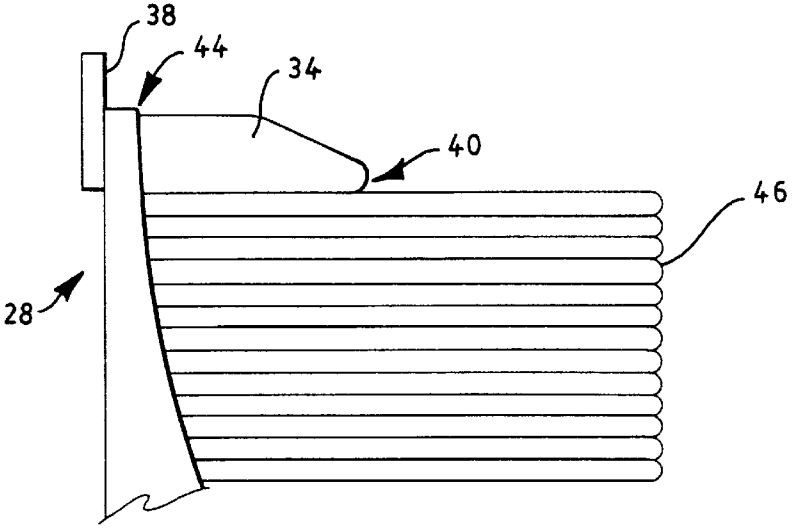
FIG. 6 a side view illustration of an overfill bracket with a over-capacity supply of folded sheets.

FIG. 6 depicts the mounting frame 26 with an over-capacity of folded sheets 46. It is clear from the illustration, that an over-capacity of folded sheets 46 displaces the lower section 40 of the overfill bracket 34 vertically so the upper portion 38 of the overfill bracket 34 protrudes beyond the upper edge 44 of the mounting frame 26 thereby preventing the mounting frame 26 from engaging the cover 10. That is, the upper portion 38 of the overfill bracket 34 blocks the cover 10 from fitting snugly against the mounting frame 26.

Figure 9:
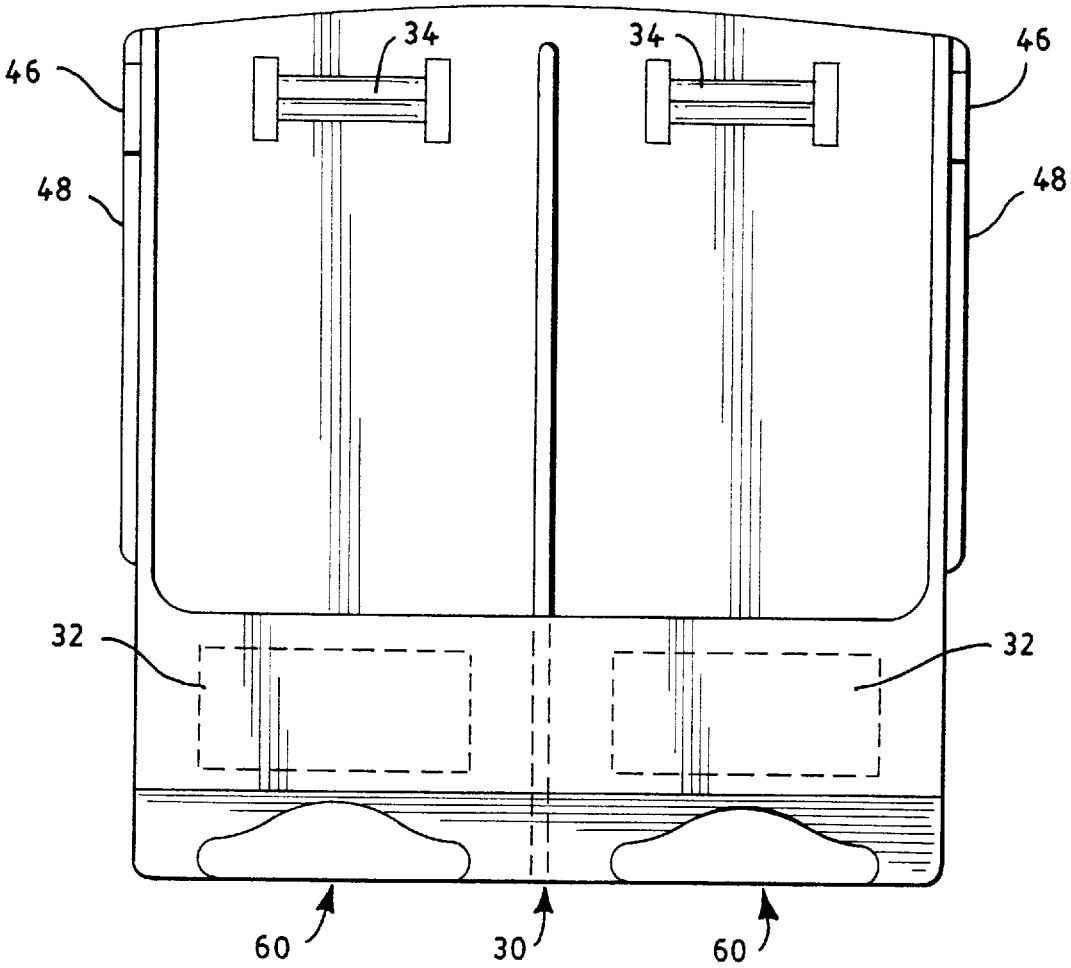
FIG. 9 is a front view illustration of a mounting frame from an exemplary overfill prevention system.

In an aspect of the invention, the overfill prevention system may include means to prevent deformation of the cover to override an overfill bracket displaced by an over-capacity of folded sheets. For example, a person attempting to engage the cover 10 and the mounting frame 26 holding an over-capacity of folded sheets 46 may attempt to pinch or squeeze the sides of the cover 10 together causing top panel 18 of the cover it to buckle vertically in order to clear the upper portion 38 of the overfill bracket 34. Accordingly, in an embodiment of the invention, one or more ribs 46 depicted in FIGS. 2, 7 and 9 mounted on the edge 48 of back panel 28 will prevent the pinched or squeezed sides of the cover 10 from properly engaging the mounting frame 26. That is, the ribs 46 present a solid surface which prevent the cover 10 from fully seating on the mounting frame 26. Thus, unable to close the dispenser, the user or maintainer of the dispenser is forced to remove the excess folded sheets permitting proper dispensing to continue.

Figure 8A:
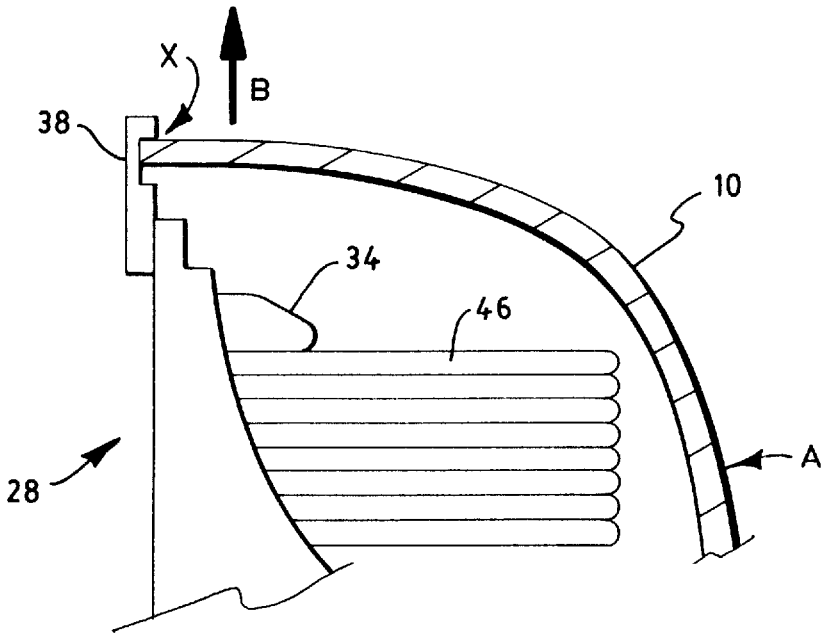
FIG. 8A is a side view illustration of an embodiment of an exemplary overfill prevention system which includes means to prevent deformation of the cover.
Figure 8B:
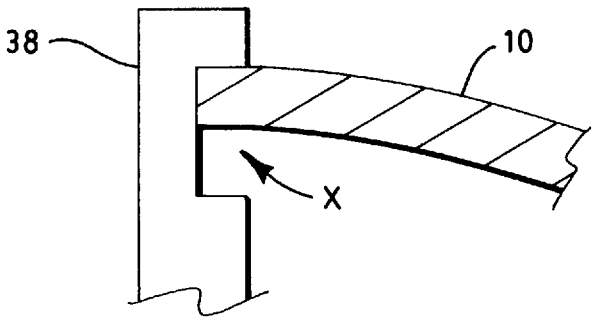
FIG. 8B is an illustration of a detail of FIG. 8A.

Referring now to FIG. 8A, there is shown a side view of another embodiment of the overfill prevention system which includes means to prevent deformation of the cover to override an overfill bracket displaced by an over-capacity of folded sheets. For example, a person attempting to engage the cover 10 and the mounting frame 26 holding an over-capacity of folded sheets 46 may apply a force "A" to the cover 10 in an attempt to vertically buckle the top panel 18 of the cover 10 in a direction "B" so it slides over the upper portion 38 of the overfill bracket 34 as the cover 10 is closed against the mounting frame 26. Accordingly, in an embodiment of the invention, a slot "X" placed in the upper portion 38 of the overfill bracket 34 facing the cover as depicted in FIGS. 3, 4, 8A and 8B will prevent the leading edge of the top panel 18 of the cover 10 from sliding past the displaced overfill bracket 34. The slot "X" will trap the leading edge of the top panel 18 of the cover 10. This prevents the cover 10 from properly seating on the mounting frame 26. Thus, unable to close the dispenser, the user or maintainer of the dispenser is forced to remove the excess folded sheets permitting proper dispensing to continue.

Figure 10:
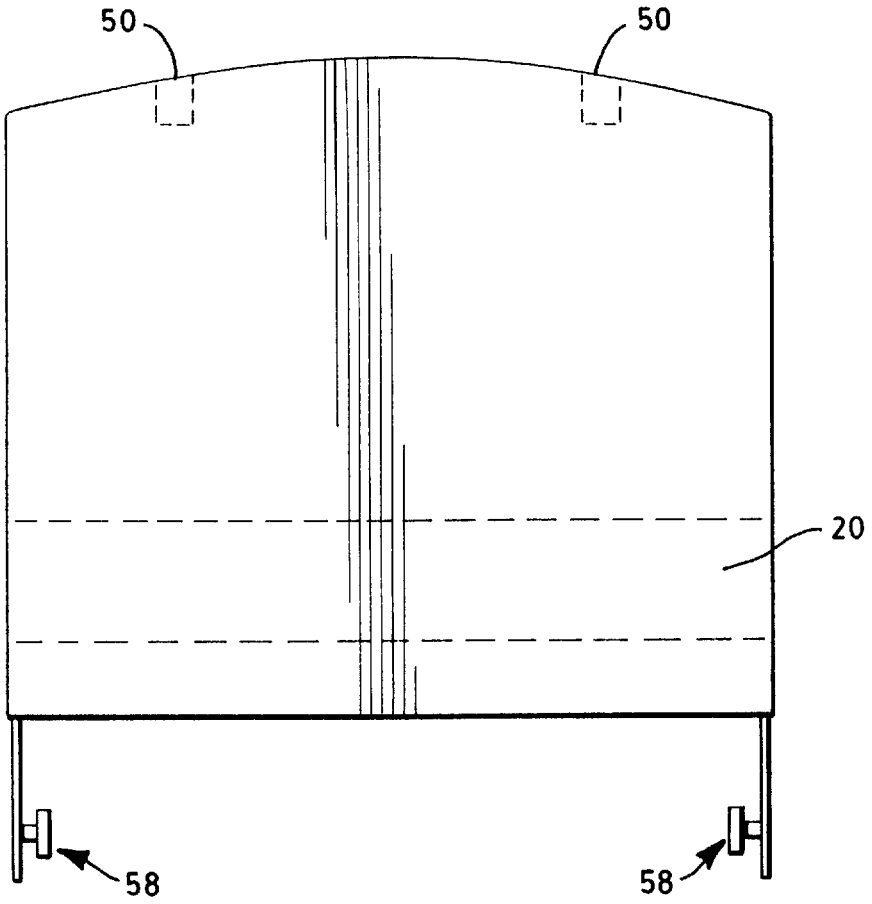
FIG. 10 is a front view illustration of a cover from an exemplary overfill prevention system.

In another aspect of the invention, the overfill prevention system may include means to prevent folded sheets from being positioned over the overfill bracket 34. In some situations, a person loading the dispenser may attempt to store the excess folded sheets in the small space between the top of the overfill bracket 34 and the top panel 18 of the cover 10. Referring now to FIG. 10, one or more ribs 50 may be mounted on an interior portion of the top panel 18 of the cover 10, the ribs 50 are positioned to contact folded sheets positioned over the overfill bracket 34 so the mounting frame 26 is prevented from engaging the cover 10. In addition, the overfill bracket 34 may have a sloped surface as can be seen in FIG. 4 which may cause excess folded sheets placed on the overfill bracket to fall off.

Figure 11A:
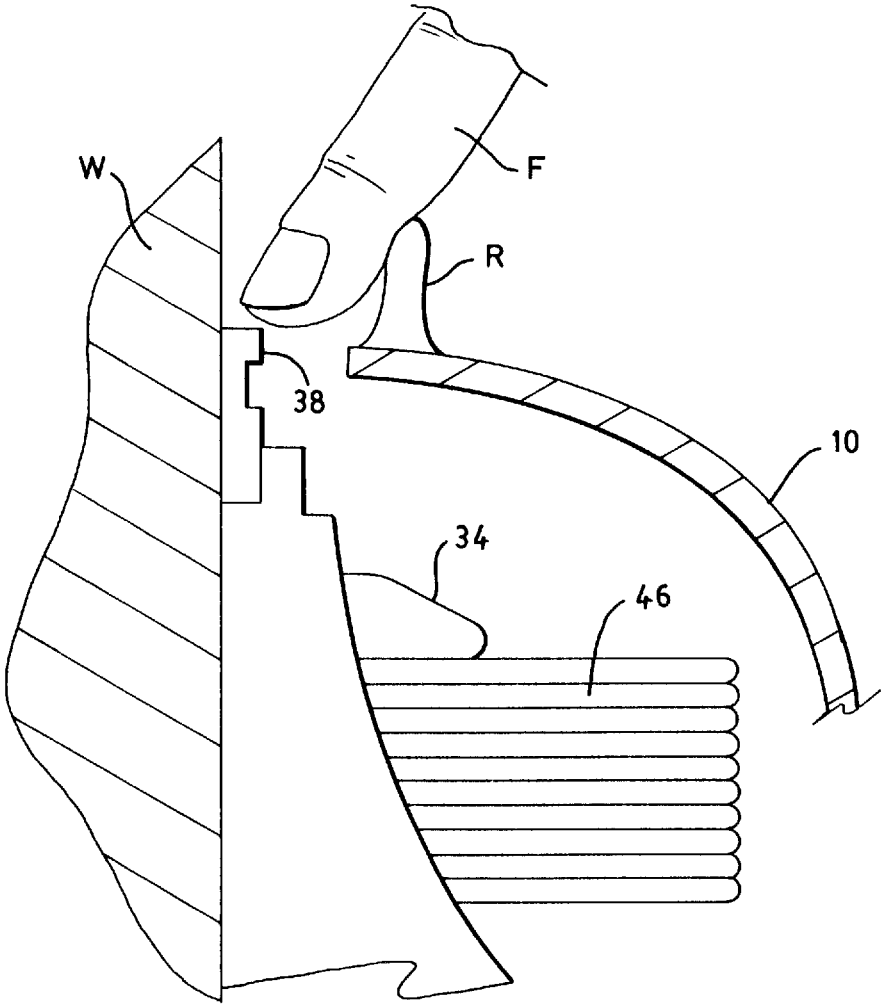
FIG. 11A is a side view illustration of an exemplary overfill prevention system which includes means to prevent pushing against or pushing back an overfill bracket.
Figure 11B:
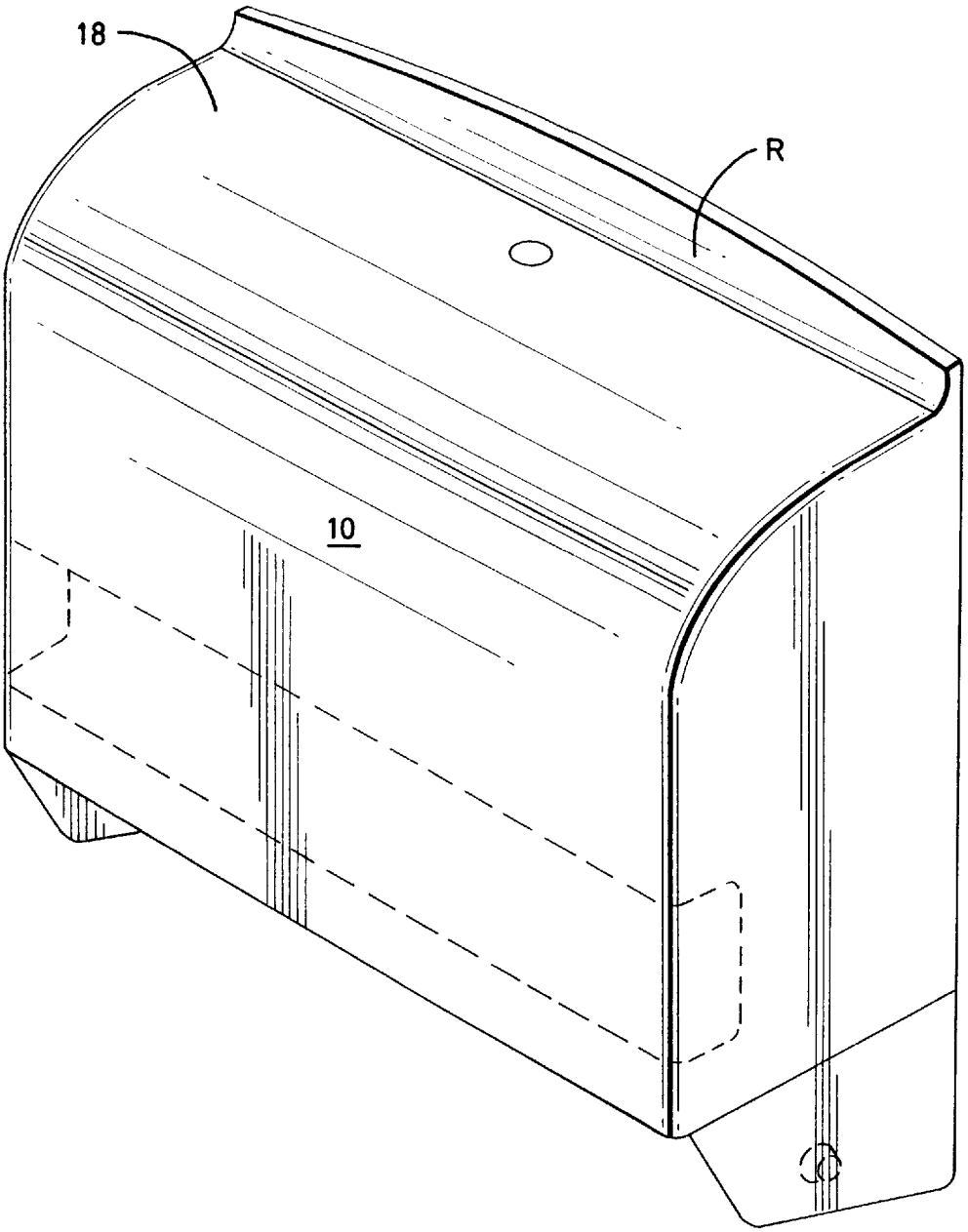
FIG. 11B is a perspective view illustration of a cover from an exemplary overfill prevention system which includes means to prevent pushing against or pushing back an overfill bracket.

In another embodiment of the invention, the overfill prevention system may include means to prevent pushing against or pushing back an overfill bracket 34 displaced by an over-capacity of folded sheets 46 in an attempt to override it. Referring now to FIG. 11A, a person attempting to engage the cover 10 and the mounting frame 26 holding an over-capacity of folded sheets 46 may try to use a finger "F" or an object to push against or push down the upper portion 38 of the overfill bracket 34 and, at the same time, slam the cover 18 against the mounting frame 26 to get the cover 10 and mounting frame 26 engaged. Accordingly, in an embodiment of the invention, a flange or ridge "R" is added to the top panel 18 of the cover 10. The flange or ridge "R" may have a height ranging from about ⅜ inch to one inch or more (e.g., 2, 3, or more inches). When the dispenser is mounted on a wall or against a backing "W", the flange or ridge "R" traps a finger or object pushing against the overfill bracket 34 slowing withdrawal of the finger or object sufficiently to allow the overfill bracket 34 to return to its displaced position thereby preventing the cover 10 from properly seating on the mounting frame 26. An exemplary flange or ridge "R" is shown in FIG. 11B (in a perspective view) as it extends across the top panel 18 of the cover 10. Of course, the flange or ridge "R" may be configured so it extends across only a portion (or portions) of the cover where it would interfere with attempts to override the overfill bracket 34.

It may be noted that using a finger or object to push down or against the overfill bracket 34 to override it compresses the over-capacity stack of folded sheets. As the finger or object is removed and the downward force or pressure against the overfill bracket 34 is reduced, the over-capacity stack of folded sheets generally tends to spring back and push the overfill bracket 34 back into its displaced position.

In an aspect of the invention, the cover 10 is attached to the mounting frame 26. Desirably, the cover 10 is pivotally attached to the mounting frame 26 by attachment means 24. The attachment means 24 may include a first side portion 52 and a second side portion 54 of the mounting frame (see FIG. 2). Each side portion 52, 54 includes a pivot opening 56 (see FIGS. 2 and 7). Pivot links 58 incorporated into the cover (see FIG. 10). The pivot links 58 are adapted to mount into the pivot openings 56 in the side portions 52, 54 of the mounting frame 56.

In an aspect of the present invention, the cover 10 may include a recessed section (not shown) on an interior portion of the top panel 18. This recessed section can be positioned to fit over the overfill bracket 34 such that the overfill bracket 34 is not prematurely engaged in the absence of an over-capacity of folded sheets in the dispenser.

Figure 7:
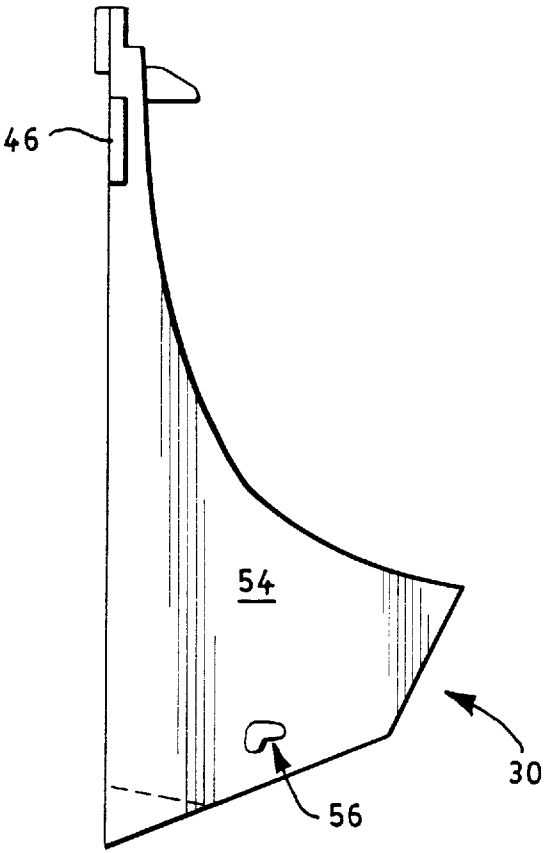
FIG. 7 is a side view illustration of a mounting frame from an exemplary overfill prevention system.

The overfill prevention system of the present invention may also include improved dispensing geometry features. Referring to FIG. 7, the bottom portion 30 of the mounting frame 26 defining a dispensing opening 60 may be set at an angle ranging from about 5 degrees to about 20 degrees so the dispensing opening 60 opens up toward the front of the dispenser. For example, the bottom portion 30 of the mounting frame 26 defining the dispensing opening 60 may be set at an angle ranging from about 7 degrees to about 18 degrees. As another example, the bottom portion of the mounting frame defining may be set at an angle ranging from about 10 degrees to about 15 degrees.

Figure 12:
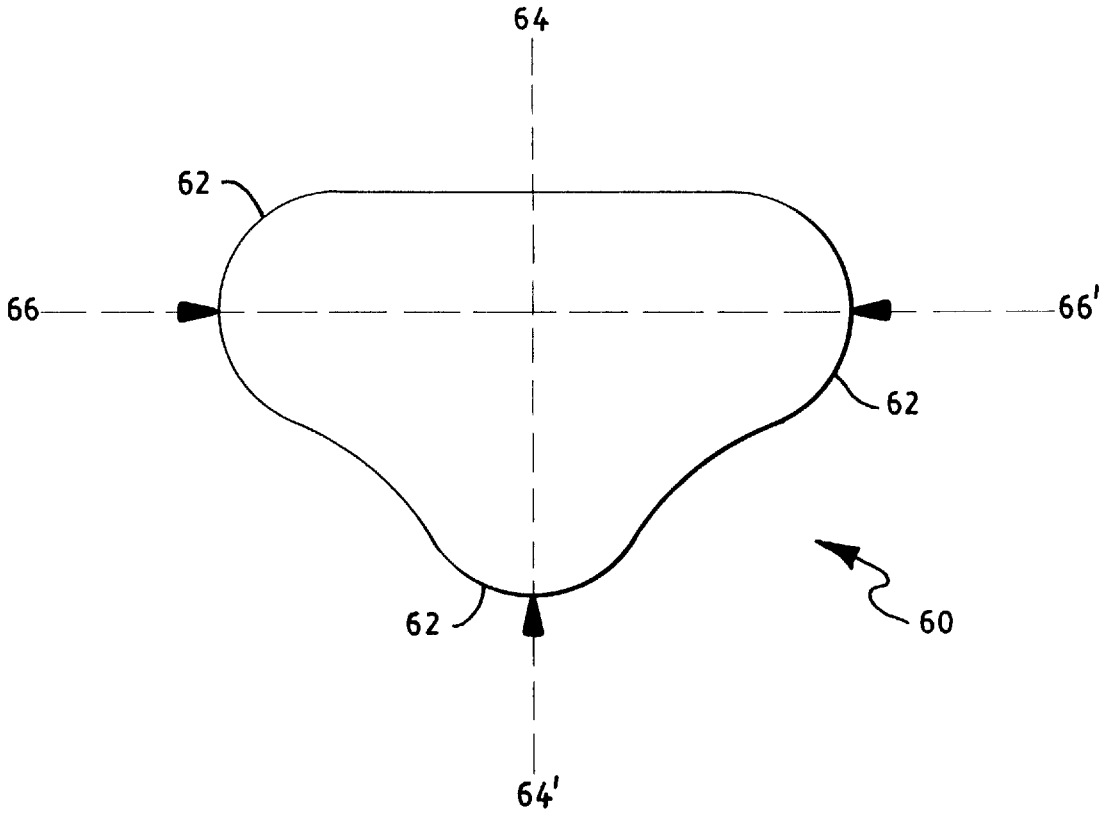
FIG. 12 is an illustration of a dispensing opening from an exemplary overfill prevention system.

Referring now to FIG. 12, the dispensing opening 60 may have a generally triangular shape with rounded edges 62. Desirably, the height of the triangle which is represented by the line 64–64' may range from about 0.5 to about 0.85 times the base of the triangle which is represented by the line 66–66'. For example, the height of the triangle may range from about 0.6 to about 0.75 times the base of the triangle. As another example, the height of the triangle may range from about 0.67 to about 0.7 times the base of the triangle.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An overfill prevention system for an folded sheet dispenser, comprising:

a cover including a front face, a first side panel, a second side panel and a top panel;

a mounting frame adapted to hold a supply of folded sheets and to engage the cover, the mounting frame including a back panel and a bottom portion having at least one dispensing opening;

at least one overfill bracket movably connected to the mounting frame such that an over-capacity of folded sheets in the mounting frame displaces the overfill bracket to prevent the mounting frame from engaging the cover; and means to prevent deformation of the cover to override an overfill bracket displaced by an over-capacity of folded sheets, wherein the means to prevent deformation of the cover comprise at least two ribs mounted on opposite edges of the mounting frame so that the ribs prevent the mounting frame from engaging the cover when the cover is deformed to override an overfill bracket displaced by an over-capacity of folded sheets.

2. An overfill prevention system for an folded sheet dispenser, comprising:

a cover including a front face, a first side panel, a second side panel and a top panel;

a mounting frame adapted to hold a supply of folded sheets and to engage the cover, the mounting frame including a back panel and a bottom portion having at least one dispensing opening;

at least one overfill bracket movably connected to the mounting frame such that an over-capacity of folded sheets in the mounting frame displaces the overfill bracket to prevent the mounting frame from engaging the cover; and means to prevent folded sheets from being positioned over the overfill bracket, wherein the means to prevent folded sheets from being positioned over the overfill bracket comprise ribs mounted on an interior portion of the top panel of the cover, the ribs being positioned to contact folded sheets positioned over the overfill bracket so the mounting frame is prevented from engaging the cover.

3. An overfill prevention system for an folded sheet dispenser, comprising:

a cover including a front face a first side panel a second side panel and a top panel;

a mounting frame adapted to hold a supply of folded sheets and to engage the cover, the mounting frame including a back panel and a bottom portion having at least one dispensing opening;

at least one overfill bracket having a lower section and an upper section, the bracket being movably connected to the mounting frame such that an over-capacity of folded sheets in the dispenser displaces the lower section of the bracket causing the upper section of the bracket to protrude from the mounting frame to prevent the mounting frame from engaging the cover; and means to prevent deformation of the cover to override an overfill bracket displaced by an over-capacity of folded sheets, wherein the means to prevent deformation of the cover comprise at least two ribs mounted on opposite edges of the mounting frame so that the ribs prevent the mounting frame from engaging the cover when the cover is deformed to override an overfill bracket displaced by an over-capacity of folded sheets.

4. An overfill prevention system for an folded sheet dispenser, comprising:

a cover including a front face, a first side panel, a second side panel and a top panel;

a mounting frame adapted to hold a supply of folded sheets and to engage the cover, the mounting frame including a back Panel and a bottom portion having at least one dispensing opening;

at least one overfill bracket having a lower section and an upper section, the bracket being movably connected to the mounting frame such that an over-capacity of folded sheets in the dispenser displaces the lower section of the bracket causing the upper section of the bracket to protrude from the mounting frame to Prevent the mounting frame from engaging the cover; and means to prevent folded sheets from being positioned over the overfill bracket, wherein the means to prevent folded sheets from being positioned over the overfill bracket comprise ribs mounted on an interior portion of the top panel of the cover, the ribs being positioned to contact folded sheets positioned over the overfill bracket so the mounting frame is prevented from engaging the cover.

* * * * *